US012545545B2

(12) United States Patent
Kazama

(10) Patent No.: US 12,545,545 B2
(45) Date of Patent: Feb. 10, 2026

(54) SHEET STACKER AND PRINTING APPARATUS

(71) Applicant: Ikumi Kazama, Kanagawa (JP)

(72) Inventor: Ikumi Kazama, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 6 days.

(21) Appl. No.: 18/665,593

(22) Filed: May 16, 2024

(65) Prior Publication Data

US 2024/0391723 A1 Nov. 28, 2024

(30) Foreign Application Priority Data

May 24, 2023 (JP) ..... 2023-085515

(51) Int. Cl.
*B65H 29/24* (2006.01)
*B65H 29/14* (2006.01)

(52) U.S. Cl.
CPC ..... *B65H 29/247* (2013.01); *B65H 29/14* (2013.01); *B65H 2301/4212* (2013.01); *B65H 2801/21* (2013.01)

(58) Field of Classification Search
CPC ..... B65H 29/003; B65H 29/02; B65H 29/04; B65H 29/041; B65H 29/16; B65H 29/18; B65H 29/245–247; B65H 29/28
See application file for complete search history.

(56) References Cited

U.S. PATENT DOCUMENTS 4,083,556 A * 4/1978 Schilling ..... B65H 29/52 271/204
4,317,563 A * 3/1982 Zimmerman ..... B65H 29/041 271/211
4,643,414 A * 2/1987 Weisgerber ..... B65H 29/247 271/211
5,445,372 A * 8/1995 Blaser ..... B65H 43/00 271/211
6,273,417 B1 * 8/2001 Berlingen ..... B65H 29/041 271/211
10,822,191 B2 * 11/2020 Johnson ..... B65H 29/125
11,479,433 B2 * 10/2022 Tamura ..... B65H 29/125
11,760,591 B2 * 9/2023 Tamura ..... B65H 29/247 270/58.11
2020/0137246 A1 4/2020 Johnson et al.
(Continued)

FOREIGN PATENT DOCUMENTS

DE 10 2011 017 217 A1 10/2012
JP 2005-008355 A 1/2005
(Continued)

OTHER PUBLICATIONS

Extended European Search Report issued Oct. 11, 2024 in European Patent Application No. 24177024.7, 9 pages.

*Primary Examiner* — Michael McCullough
(74) *Attorney, Agent, or Firm* — XSENSUS LLP

(57) ABSTRACT

A sheet stacker includes: a loader to which a sheet bundle is to be loaded; a guide to receive a leading end of a sheet conveyed to an area above the loader, and guide the sheet along a guide path above the loader in a conveyance direction; a blower disposed above the guide path of the guide to blow air downward to the sheet; and multiple lines: disposed above the guide path of the guide; and extending in a direction inclined relative to the conveyance direction.

19 Claims, 4 Drawing Sheets

(56) References Cited

U.S. PATENT DOCUMENTS

| | | | | |
|---|---|---|---|---|
| 2020/0299093 | A1 | 9/2020 | Tamura | |
| 2021/0395033 | A1* | 12/2021 | Kazama | B65H 31/10 |
| 2023/0127575 | A1 | 4/2023 | Kazama | |
| 2023/0286769 | A1 | 9/2023 | Kazama | |
| 2024/0351816 | A1* | 10/2024 | Kazama | B65H 29/247 |

FOREIGN PATENT DOCUMENTS

| | | | |
|---|---|---|---|
| JP | 2008-094582 | A | 4/2008 |
| JP | 2020-158305 | A | 10/2020 |

* cited by examiner

SHEET STACKER AND PRINTING APPARATUS

CROSS-REFERENCE TO RELATED APPLICATION

This patent application is based on and claims priority pursuant to 35 U.S.C. § 119 (a) to Japanese Patent Application No. 2023-085515, filed on May 24, 2023, in the Japan Patent Office, the entire disclosure of which is hereby incorporated by reference herein.

BACKGROUND

Technical Field

The present embodiment relates to a sheet stacker and a printing apparatus.

Related Art

A sheet stacker includes a loader to which a sheet bundle is to be loaded, a guide that receives the leading end of a sheet conveyed to an area above the loader to guide the sheet downstream in the conveyance direction, and a blower that is disposed above a guide path based on the guide and blows air to the sheet. For example, a sheet stacker, in which the blower starts to blow air when the guide separates from the leading end of a sheet.

However, an increase in the rate of sheet conveyance to an area above the loader for an improvement in productivity causes conveyance failure.

SUMMARY

In an aspect of the present disclosure, a sheet stacker includes: a loader to which a sheet bundle is to be loaded; a guide to: receive a leading end of a sheet conveyed to an area above the loader; and guide the sheet along a guide path above the loader in a conveyance direction; a blower disposed above the guide path of the guide to blow air downward to the sheet; and multiple lines: disposed above the guide path of the guide; and extending in a direction inclined relative to the conveyance direction.

BRIEF DESCRIPTION OF THE DRAWINGS

A more complete appreciation of embodiments of the present disclosure and many of the attendant advantages and features thereof can be readily obtained and understood from the following detailed description with reference to the accompanying drawings, wherein.

Figure 1A:
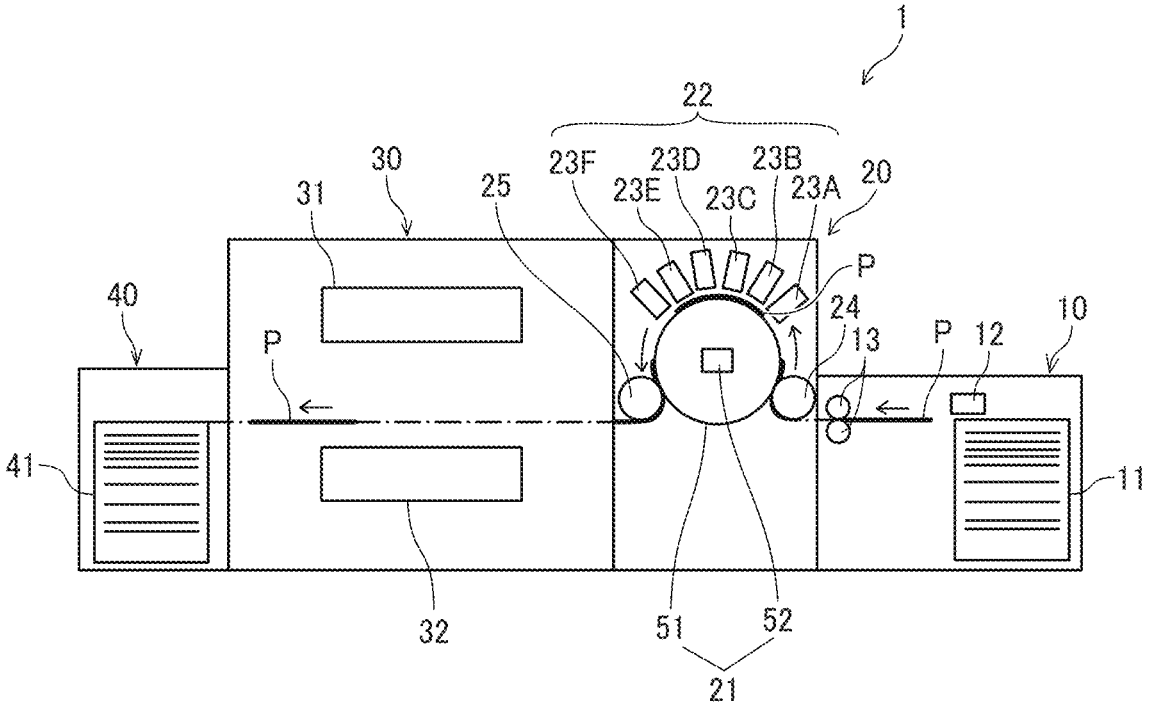
FIGS. 1A and 1B are explanatory views for a printing apparatus according to an embodiment.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity.

However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a," "an," and "the" are intended to include the plural forms as well, unless the context clearly indicates otherwise.

Figure 1B:
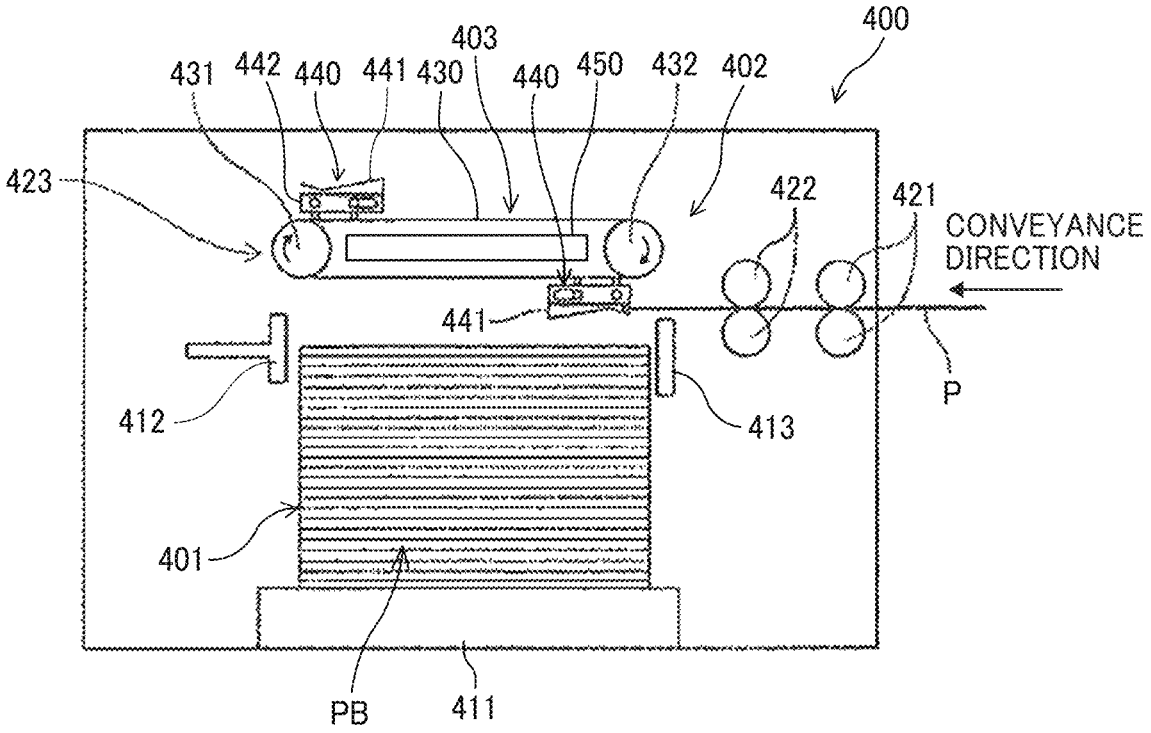

Embodiments of the present embodiment will be described below with reference to the accompanying drawings. An exemplary printing apparatus according to the present embodiment will be described with reference to FIGS. 1A and 1B. FIG. 1A is a schematic explanatory view for the printing apparatus. FIG. 1B is an enlarged view of part of the printing apparatus.

A printing apparatus 1 includes a loader 10, a printer 20, a dryer 30, and an unloader 40 as a sheet stacker according to the present embodiment. In the printing apparatus 1, the printer 20 applies liquid to a sheet P loaded from the loader 10 to perform desired printing, and the dryer 30 dries the liquid having adhered to the sheet P. Then, the sheet P is ejected to the unloader 40.

The loader 10 includes a load tray 11 on which multiple sheets P can be loaded, a feeder 12 that separates a sheet P from the multiple sheets P on the load tray 11 to feed the sheet P, and a registration roller pair 13 that feeds the sheet P to the printer 20.

As the feeder 12, used can be any feeder, such as a feeder including a roller or roller or a feeder based on air suction. After the leading end of the sheet P fed from the load tray 11 by the feeder 12 reaches the registration roller pair 13, the registration roller pair 13 drives at a predetermined timing to feed the sheet P to the printer 20.

The printer 20 includes a sheet conveyor 21 that conveys the sheet P. The sheet conveyor 21 includes a drum 51 as a bearer (rotator) that rotates while bearing the sheet P on its circumferential face and a sucker 52 as a suction means that generates suction force on the circumferential face of the drum 51.

The printer 20 includes a liquid discharger 22 that discharges liquid to the sheet P borne on the drum 51 of the sheet conveyor 21.

The printer 20 includes a delivery barrel 24 that receives the fed sheet P and delivers the sheet P to the drum 51 and a relay barrel 25 that relays the sheet P conveyed by the drum 51 to the dryer 30.

The sheet P conveyed from the loader 10 to the printer 20 is conveyed in accordance with rotation of the delivery barrel 24 while the leading end of the sheet P is being gripped by a gripping means (sheet gripper) with which the delivery barrel 24 is provided. The sheet P conveyed by the delivery barrel 24 is delivered to the drum 51 at a position opposed to the drum 51.

The drum 51 has its surface provided with a gripping means (sheet gripper). Thus, the leading end of the sheet P is gripped by the gripping means (sheet gripper). The drum 51 has its surface having multiple dispersed suction holes. The sucker 52 as a suction means generates suction air currents inward through the desired suction holes of the drum 51.

Then, the sheet P delivered from the delivery barrel 24 to the drum 51 is conveyed in accordance with rotation of the drum 51 while being attracted and borne on the drum 51 due to the suction air currents by the sucker 52, with its leading end gripped by the sheet gripper.

The liquid discharger 22 includes discharge units 23 (23A to 23F) as liquid discharge means. For example, the discharge units 23A, 23B, 23C, and 23D discharge, respectively, liquid in cyan (C), liquid in magenta (M), liquid in yellow (Y), and liquid in black (K). In addition, the discharge units 23E and 23F are each used to discharge liquid in any of Y, M, C, and K or special liquid, such as liquid in white or liquid in gold (silver). The liquid discharger 22 can further include a discharge unit that discharges processing liquid, such as surface coating liquid.

The discharge units 23 are each, for example, a full-line type of head including multiple liquid discharge heads disposed on a base member, in which each liquid discharge head includes a nozzle array in which multiple nozzles is arrayed.

The discharge operation of each discharge unit 23 in the liquid discharger 22 is controlled based on a drive signal corresponding to print information. At the time of passage of the sheet P borne on the drum 51 through a region facing the liquid discharger 22, the discharge units 23 each discharge liquid in the corresponding color to print, on the sheet P, an image corresponding to the print information.

The dryer 30 includes a drying mechanism 31 that dries the liquid having adhered on the sheet P due to the printer 20 and a suction conveyance mechanism 32 that conveys the sheet P conveyed from the printer 20 while suctioning the sheet P.

After the suction conveyance mechanism 32 receives the sheet P conveyed from the printer 20, the sheet P is conveyed while passing under the drying mechanism 31 and then is delivered to the unloader 40.

At the time of passage of the sheet P under the drying mechanism 31, the liquid on the sheet P is subjected to drying. Thus, the liquid component, such as water, in the liquid evaporates, so that the colorant contained in the liquid is fixed on the sheet P. In addition, the sheet P is inhibited from curling.

The unloader 40 is achieved with the sheet stacker according to the present embodiment and includes a stack section 401 as a loader to which a sheet bundle PB is to be loaded. The sheet P conveyed from the dryer 30 is stacked in order on the stack section 401 for retention.

Note that, for example, the printing apparatus 1 can include a pre-processing unit that is disposed upstream of the printer 20 and performs pre-processing to the sheet P and a post-processing unit that is disposed between the dryer 30 and the unloader 40 and performs post-processing to the sheet P to which the liquid has adhered.

An exemplary pre-processing unit performs pre-coating such that the sheet P is applied with processing liquid that reacts with the liquid to inhibit bleeding. An exemplary post-processing unit performs sheet reverse conveying such that the sheet P subjected to printing by the printer 20 is reversed and then is re-fed to the printer 20 for double-sided printing of the sheet P. Another exemplary post-processing unit performs processing to bind multiple sheets P.

Note that, in the present embodiment, the printing apparatus has been exemplarily described as an inkjet recording apparatus. The "printing apparatus" is not limited to an apparatus that includes a liquid discharge head that discharges liquid to the face to be dried of a sheet member and visualizes a meaningful image, such as a character or a figure, with the discharged liquid and thus may be, for example, an apparatus that forms a meaningless pattern. The material of such a sheet member is not limited and may be any material to which liquid can adhere even temporarily, such as paper, thread, fiber, fabric, leather, metal, plastic, glass, wood, or ceramic. For example, the material may be any material used for film products, cloth products for clothing, building materials such as wallpaper or flooring, or leather products. The "printing apparatus" can include means for feeding a medium to which liquid can adhere, means for conveying a medium to which liquid can adhere, means for ejecting a medium to which liquid can adhere, a pre-processing device, and a post-processing device.

The "liquid" may have any viscosity or surface tension, provided that the liquid can be discharged from a head. Such liquid is preferably, but not particularly limited to, not more than 30 mPa·s in viscosity at normal temperature and normal pressure or due to heating or cooling. More specific examples of the liquid include a solution, a suspension, and an emulsion that contain a solvent, such as water or an organic solvent, a colorant, such as dye or pigment, a functional material, such as a polymerizable compound, resin, or a surfactant, a biocompatible material, such as deoxyribonucleic acid (DNA), an amino acid, protein, or calcium, or an edible material, such as a natural pigment. Such a solution, a suspension, and an emulsion can be used, for example, for inkjet inks or surface processing liquids.

Although the printer including liquid discharge means has been exemplarily described, means different from such liquid discharge means may be provided for printing.

Next, a sheet stacker including a sheet guide and a sheet conveyor according to an embodiment of the present embodiment will be described with reference to FIG. 1B. FIG. 1B is an explanatory view for the sheet stacker.

A sheet stacker 400 includes a stack section 401 and a sheet conveyor 402. The stack section 401 serves as a loader to which a sheet bundle PB is to be loaded. The sheet conveyor 402 conveys a sheet P to the stack section 401.

The stack section 401 includes a table 411 on which the sheet bundle PB is to be loaded, a front fence (jogger) 412, a rear fence 413, and lateral fences.

The sheet conveyor 402 includes conveying rollers 421 and 422 that convey the sheet P fed from the dryer 30 and a sheet guide 423 as a sheet guide according to the present embodiment.

The sheet guide 423 receives the leading end (downstream end) of the sheet P being conveyed from the conveying roller 422 to the stack section 401 and guides the sheet P downstream in the conveyance direction.

The sheet guide 423 includes an endless belt 430 stretched around a driving roller 431 and a driven roller 432 and a guide 440 attached to the belt 430. The guide 440 includes a guide member 441 and an attachment 442 to hold the downstream end of the sheet P. Such guides 440 can be attached to multiple places on the belt 430 (two places in the example of FIG. 1B).

In response to elapse of a certain time after detection of the sheet P upstream of the conveying roller 422, the belt 430 of the sheet guide 423 runs circumferentially, so that the leading end of the sheet P is inserted into the guide member 441 of either guide 440 due to the difference in linear speed between the guide member 441 and the conveying roller 422. The sheet guide 423 may be referred to simply as a "guide".

Then, due to the circumferential running of the belt 430, while holding the leading end of the sheet P, the guide member 441 moves downstream in the conveyance direction to guide the sheet P.

The guide member 441 has a gap larger than the thickness of the sheet P such that the leading end of the sheet P can be inserted into the gap, but has no gripping force, such as a force to grip the sheet P. The guide member 441 serves to guide the leading end of the sheet P and functions to inhibit the portion ranging from the leading end to an intermediate of the sheet P from fluttering. Note that the guide member 441 may include a clip having a gripping force to grip the leading end of the sheet P.

In response to arrival of the guide member 441 at the position of guide termination, the guide member 441 is made higher in linear speed than the conveying roller 422. Thus, the leading end of the sheet P separates from the guide member 441, so that the sheet P falls onto the stack section 401 for stacking. The stack section 401 is an example of a loader to load and stacks the sheet P.

Provided is a blower 450 as a blower that blows air to the sheet P. The blower 450 located above the stack section 401 as a loader and on the downstream side in the conveyance direction of the position at which the guide member 441 of either guide 440 receives the leading end of the sheet P blows air to the sheet P.

Figure 2A:
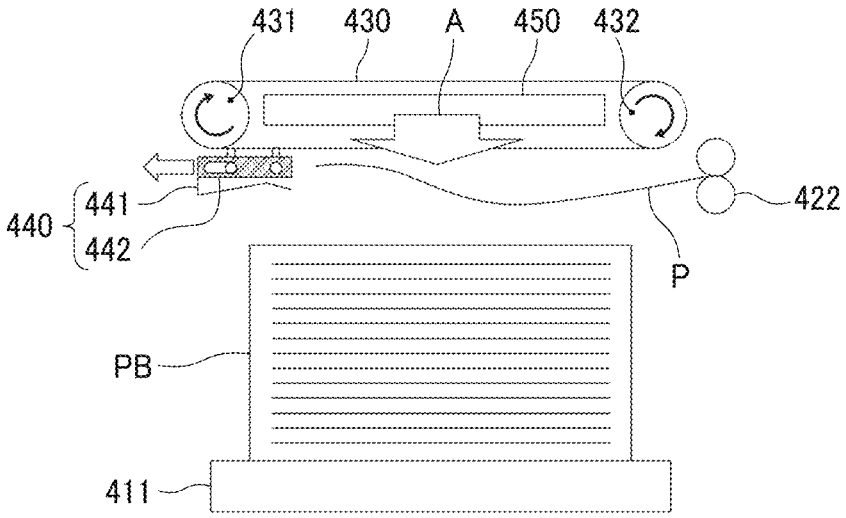
FIGS. 2A and 2B are explanatory views for main parts of the printing apparatus according to the embodiment.

FIG. 2A is an explanatory view for the above configuration with trouble due to an improvement in the rate of conveyance of the conveying roller 422 and an improvement in the rate of guiding of the guide 440 for an improvement in productivity. The trouble corresponds to conveyance failure of a sheet on a sheet conveyance path (namely, paper jam). The cause of such conveyance failure is as follows. The guide member 441 holding the leading end of a sheet accelerates just before arrival of the sheet at the position of stacking, so that the guide member 441 separates from the leading end of the sheet to cause the sheet to land at the position of stacking. The leading end of the sheet separated from the guide member 441 in high-rate conveyance of the sheet rises due to air resistance and then the edge of the leading end of the sheet is caught by an upper structure, resulting in occurrence of conveyance failure. In particular, conveyance failure based on a sheet low in rigidity tends to occur.

Figure 2B:
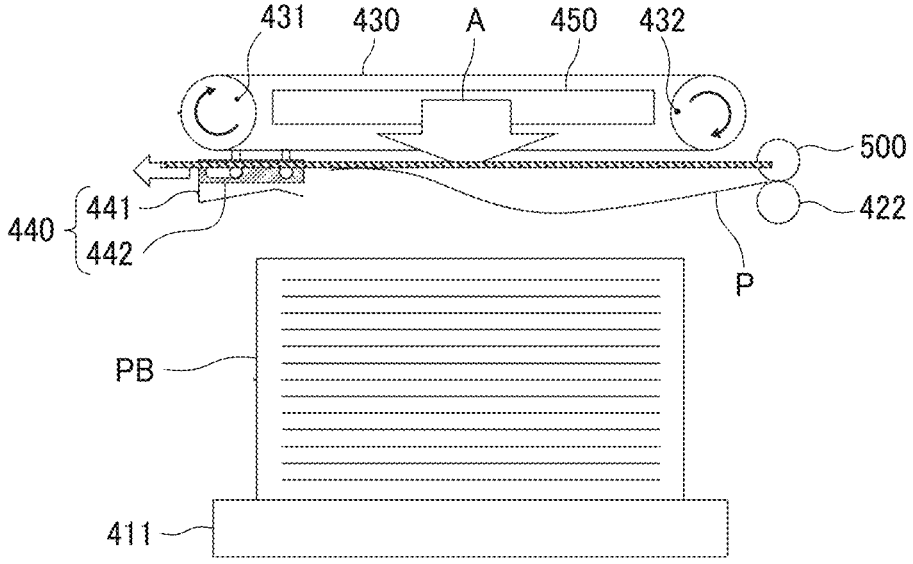

In the present embodiment, for prevention of conveyance failure due to the rise of the leading end of a sheet, multiple lines extending in the conveyance direction is disposed above a guide path based on the guide member 441 of such a guide 440. FIG. 2B is an explanatory view for such an example. A line unit 500 includes a wire as lines extending above the guide path based on the guide member 441. The line unit 500 restricts the height of rising of the leading end of the sheet due to air resistance after the sheet separates from the guide member 441. That is, the line unit 500 functions to inhibit the leading end of the sheet from rising. Such rising inhibition prevents conveyance failure with the upper structure catching the edge of the leading end of the sheet.

Referring to FIG. 2B, as an example, the belt 430 is provided with a single guide 440. However, as illustrated in FIG. 1B, multiple guides 440 may be provided.

Figure 3A:
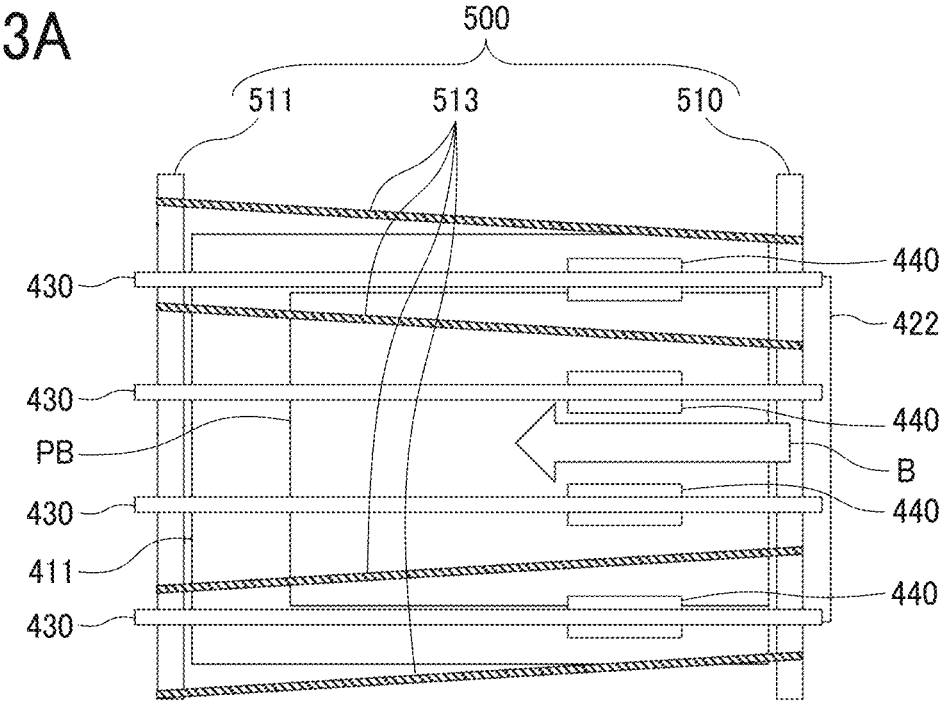
FIGS. 3A to 3C are explanatory views for a line unit.
Figure 3B:
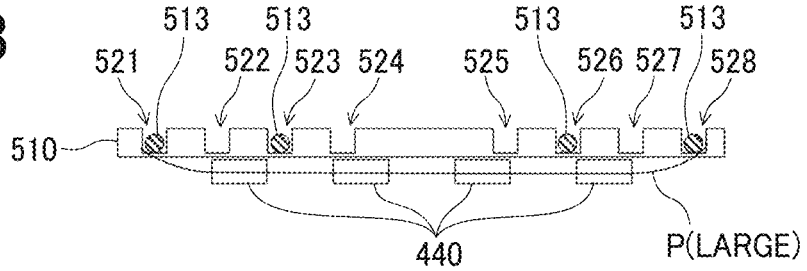
Figure 3C:
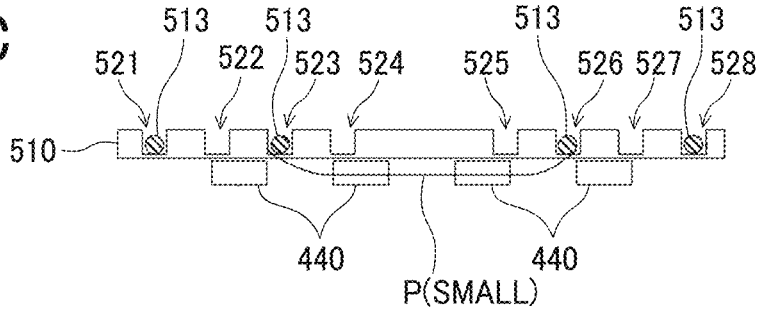

FIGS. 3A to 3C are explanatory views for the line unit 500. FIG. 3A is a bottom view of the line unit 500. FIG. 3B is a left side view of the line unit 500 with a sheet having a wide width and having its leading end restricted from rising. FIG. 3C is a left side view of the line unit 500 with a sheet having a narrow width and having its leading end restricted from rising. The line unit 500 includes multiple wires 513 each as a lines extending in the conveyance direction. In the illustrated example, four wires 513 are provided. A hollow arrow B indicates the conveyance direction (direction of sheet guiding). The wires 513 are an example of a line.

The line unit 500 includes an upstream wire positional adjustment plate 510 and a downstream wire positional adjustment plate 511. In the conveyance direction, the wires 513 each have its upstream end and downstream end located at the upstream wire positional adjustment plate 510 and the downstream wire positional adjustment plate 511, respectively. As illustrated in FIG. 3B or 3C, the positional adjustment plates each include recesses 521 to 528 as wire holders. Each wire may have its ends retained directly by the positional adjustment plates. Alternatively, the positional adjustment plates may each have a function of widthwise positioning the wires each having its ends retained at other places.

FIG. 3A illustrates four belts 430 and four guides 440, in addition to the line unit 500. FIG. 3A further illustrates the table 411 and the conveying roller 422. The belts 430 are disposed widthwise at intervals in order not to block the air blown from the blower 450. For a similar reason, the wires 513 are disposed widthwise at intervals. The blower 450 blows air downward as indicated with a hollow arrow A to enhance the productivity of the apparatus or to cause the sheet to have a stable landed pose. As illustrated, air blowing perpendicular to the surface of the sheet is most effective.

As illustrated in FIG. 3C, the interval between each of the multiple wires 513 disposed widthwise is smaller than the length in the width direction of a sheet narrowest in width from among sheets to be used. Thus, when the leading end of the sheet rises, two or more wires can be used to control the pose of the sheet. The wires 513 are disposed at intervals in the width direction intersecting the conveyance direction, and the interval between the outer wires 513 and the interval between the inner wires 513 increase downstream in the conveyance direction. Thus, even when the leading end of the sheet rises and comes in contact with any of the wires 513, the leading end of the sheet is hardly caught by the wire 513.

As illustrated in FIG. 3B or 3C, the position in the width direction of each wire 513 can be changed stepwise with the recesses 521 to 528. Thus, provided can be a simple configuration in which the interval between each wire can be manually changed depending on multiple sizes of sheets. Note that, in the example of FIGS. 3A to 3C, when the downstream end of each wire 513 is moved to the next empty recess closer to the center, all the wires are parallel as a whole.

The sheet stacker (400) includes: a loader (401) to which a sheet bundle is to be loaded; a guide (423) to: receive a leading end of a sheet conveyed to an area above the loader (401); and guide the sheet along a guide path above the loader in a conveyance direction; a blower (450) disposed above the guide path of the guide (423) to blow air downward to the sheet; and multiple lines (513): disposed above the guide path of the guide (423); and extending in a direction inclined relative to the conveyance direction.

The multiple lines (513) are disposed apart from each other with an interval in a width direction intersecting the conveyance direction, and the interval increases toward downstream in the conveyance direction.

The sheet stacker (400) includes: an upstream plate (510) disposed at an upstream end of the guide path and extending in the width direction, the upstream plate (510) including first recesses (521 to 528) to hold an upstream end of the multiple lines; and a downstream plate (511) disposed at a downstream end of the guide path and extending in the width direction, the downstream plate (511) including second recesses (521 to 528) to hold a downstream end of the multiple lines. The positions of the multiple lines (513) in the width direction are variable in response to an arrangement of the multiple lines in the first recesses of the upstream plate and the second recesses of the downstream plate.

The sheet stacker (400) includes a position changer (600) to change each of positions of the multiple lines (513) in the width direction. The multiple lines (513) respectively include multiple wires. The guide (423) includes: multiple belts (430) stretched around a driving roller (431) and a driven roller (432) in the conveyance direction; and multiple guide members (441) respectively attached to the multiple belts (430), each of the multiple guide member 441 having a gap into which a leading end of the sheet P is insertable, and the multiple lines are disposed above the guide member. The multiple lines (513) are arranged in a horizontal plane.

Modification

Figure 4:
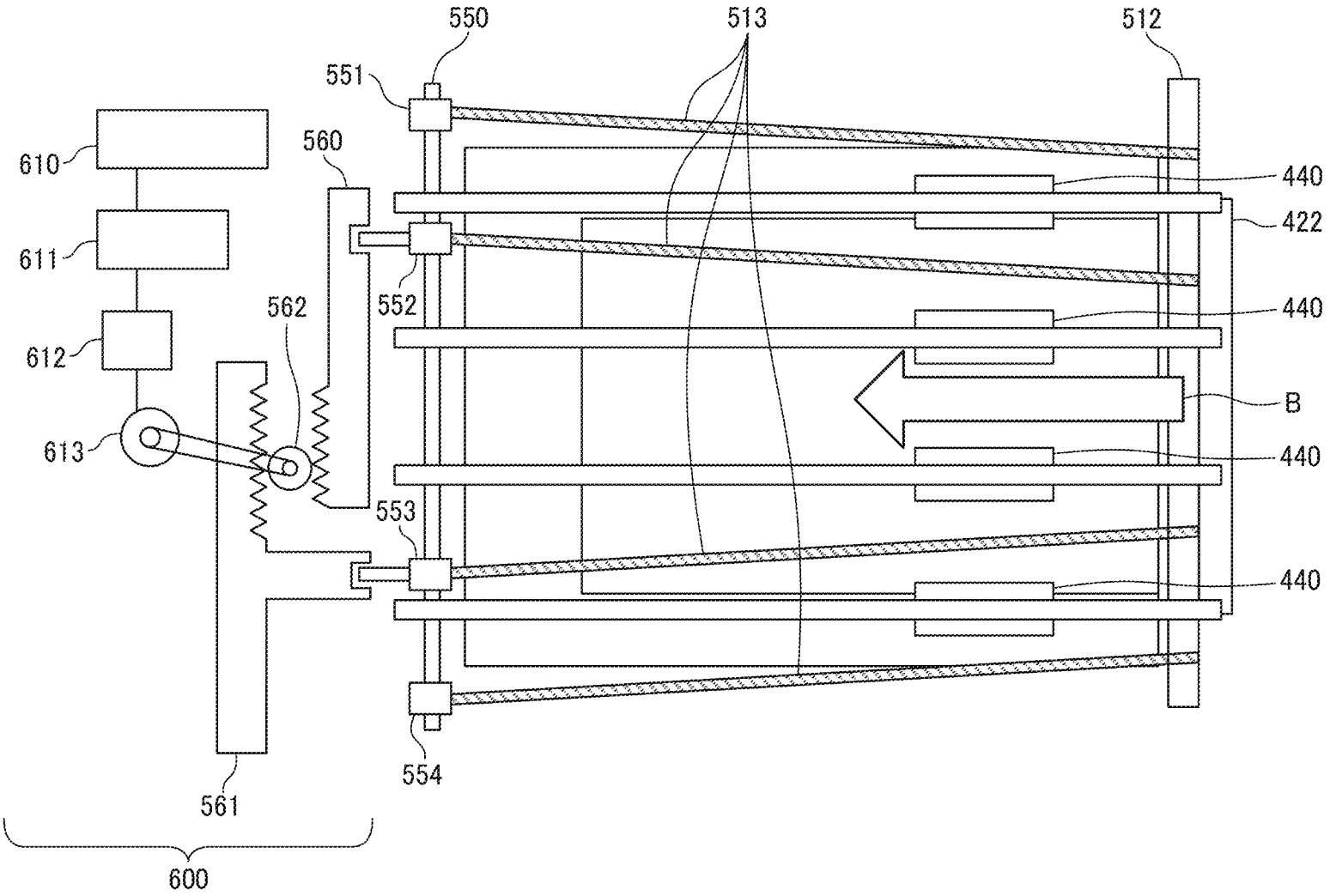
FIG. 4 is an explanatory view for a modification.

FIG. 4 is an explanatory view for a modification.

The positions of the downstream ends in the conveyance direction of two inner wires 513 from among four wires 513 can be changed widthwise. Specifically, the positionally variable downstream ends of the inner wires 513 are secured to a front slider 552 and a rear slider 553 supported movably on a shaft member 550. The downstream ends of two outer wires 513 from among the four wires 513 are secured to a front attachment 551 and a rear attachment 554 secured to the shaft member 550.

The front slider 552 and the rear slider 553 engage, respectively, with a front rack 560 and a rear rack 561 that are slidable by a pinion 562 for a movement motor 613. Thus, the front slider 552 and the rear slider 553 can move due to rotation of the pinion 562 by the movement motor 613 such that the interval between the two inner wires 513 is changed.

A motor drive circuit 612 for the movement motor 613 is connected to a controller 611 to which an operation panel 610 is connected. For changes in the positions of the downstream ends of the two inner wires 513 based on control of the movement motor 613, sheet type information, such as size information, is acquired from operation information on the operation panel 610 and then control is performed based on pinion rotation operation position information stored in association with the sheet type information. Use of such size information enables automatic movement of the four wires 513 to positions in the width direction that correspond to the size of each sheet (particularly, width size) and are suitable to restrict rising of the leading end of each sheet due to air resistance.

In the example, the downstream ends of the two inner wires are variable in position. Instead of this, similarly, the outer wires may be variable in position. Furthermore, instead of or in addition to such downstream ends in the conveyance direction, the corresponding upstream ends in the conveyance direction may be variable in position. Furthermore, a mechanism enabling changes in position is not limited to a rack-and-pinion mechanism and thus may be a different type of mechanism, such as a recirculating ball and nut type of mechanism or a solenoid type of mechanism.

Preferred embodiments of the present embodiment have been described above. However, the present embodiment is not limited to the particular embodiments. Unless otherwise particularly limited in the above description, various modifications and alterations can be made without departing from the scope of the gist of the present embodiment in the claims.

The effects in the embodiments of the present embodiment correspond to most favorable effects from the present embodiment. Thus, effects according to the present embodiment are not limited to the effects in the embodiments of the present embodiment.

The above description is exemplary, and the following aspects of the present embodiment have respective particular effects. Reference signs in parentheses with which constituents are denoted in each aspect indicate the corresponding members. However, the constituents are not limited to the members.

Aspect 1

According to Aspect 1, a sheet stacker (400) includes: a loader (401) to which a sheet bundle is to be loaded; a guide (423) configured to receive a leading end of a sheet conveyed to an area above the loader (401) to guide the sheet downstream in a conveyance direction; a blower (450) disposed above a guide path based on the guide (423), the blower (450) being configured to blow air to the sheet; and multiple lines (513) disposed above the guide path based on the guide (423), the multiple lines (513) extending in the conveyance direction. According to Aspect 1, conveyance failure with an upper structure catching the edge of the leading end of the sheet is prevented.

Aspect 2

According to Aspect 2, in the sheet stacker (400) of Aspect 1, the multiple lines (513) is disposed with an interval between the multiple lines (513) in a width direction intersecting the conveyance direction, and the interval increases downstream in the conveyance direction. According to Aspect 2, even when the leading end of the sheet rises and comes in contact with any of the lines, the leading end of the sheet is hardly caught by the lines.

Aspect 3

According to Aspect 3, in the sheet stacker (400) of Aspect 1 or 2, the multiple lines (513) is disposed with an interval between the multiple lines (513) in a width direction intersecting the conveyance direction, and the interval is smaller than a length in the width direction of the sheet. According to Aspect 3, even when the leading end of the sheet rises, the pose of the sheet can be controlled.

Aspect 4

According to Aspect 4, in the sheet stacker (400) of any one of Aspects 1 to 3, the multiple lines (513) is disposed with an interval between the multiple lines (513) in a width direction intersecting the conveyance direction, and each of the multiple lines (513) is variable stepwise in position in the width direction. According to Aspect 4, with a simple configuration, multiple sizes of sheets can be dealt with.

Aspect 5

According to Aspect 5, the sheet stacker (400) of any one of Aspects 1 to 4 further includes a position changing means (600), in which the multiple lines (513) is disposed with an interval between the multiple lines (513) in a width direction intersecting the conveyance direction, and the position changing means (600) is configured to change a position in the width direction of each of the multiple lines (513). According to Aspect 5, multiple sizes of sheets can be dealt automatically with.

Aspect 6

According to Aspect 6, a printing apparatus (1) includes the sheet stacker (400) of any one of Aspects 1 to 5. According to Aspect 6, conveyance failure with an upper structure catching the edge of the leading end of the sheet can be prevented, leading to an enhancement in productivity with an improvement in the rate of sheet conveyance.

The invention claimed is:

1. A sheet stacker comprising:

a loader to which a sheet bundle is to be loaded;

a guide to:

receive a leading end of a sheet conveyed to an area above the loader; and guide the sheet along a guide path above the loader in a conveyance direction;

a blower disposed above the guide path of the guide to blow air downward to the sheet; and multiple lines:

disposed above the guide path of the guide; and extending in a direction inclined relative to the conveyance direction, wherein:

the multiple lines are disposed apart from each other with an interval in a width direction intersecting the conveyance direction, and the interval increases toward downstream in the conveyance direction.

2. The sheet stacker according to claim 1, wherein;

the interval is smaller than a length of the sheet in the width direction.

3. The sheet stacker according to claim 1, further comprising:

an upstream plate disposed at an upstream end of the guide path and extending in the width direction, the upstream plate including first recesses to hold an upstream end of the multiple lines; and a downstream plate disposed at a downstream end of the guide path and extending in the width direction, the downstream plate including second recesses to hold a downstream end of the multiple lines, wherein positions of the multiple lines in the width direction are variable in response to an arrangement of the multiple lines in the first recesses of the upstream plate and the second recesses of the downstream plate.

4. The sheet stacker according to claim 1, further comprising:

a position changer to change each of positions of the multiple lines in the width direction.

5. The sheet stacker according to claim 1, wherein;

each of the multiple lines respectively include a corresponding wire.

6. The sheet stacker according to claim 1, wherein the guide includes:

multiple belts stretched around a driving roller and a driven roller in the conveyance direction; and multiple guide members respectively attached to the multiple belts, each of the multiple guide members having a gap into which a leading end of the sheet is insertable, and wherein the multiple lines are disposed above the guide member.

7. The sheet stacker according to claim 6, wherein;

the multiple lines are between the multiple belts in the width direction.

8. The sheet stacker according to claim 6, wherein:

the multiple belts are disposed at intervals in the width direction so as not to block air blown from the blower.

9. The sheet stacker according to claim 1, wherein;

the multiple lines are arranged in a horizontal plane.

10. A printing apparatus comprising the sheet stacker according to claim 1.

11. The printing apparatus according to claim 10, further comprising:

a dryer to dry the sheet prior to the sheet being conveyed to the sheet stacker.

12. The sheet stacker according to claim 1, further comprising:

a motor to change each of positions of the multiple lines in the width direction.

13. The sheet stacker according to claim 1, wherein:

the guide is to release the leading end of the sheet prior to the sheet landing on the loader, and the multiple lines are to restrict a height of rising of the leading end of the sheet after the sheet is released from the guide.

14. The sheet stacker according to claim 1, wherein:

the blower is downstream of a position at which the guide receives the leading end of the sheet.

15. The sheet stacker according to claim 1, further comprising:

a position changer configured to automatically change positions of at least some of the multiple lines in the width direction based on size information of the sheet.

16. The sheet stacker according to claim 1, wherein:

the multiple lines comprise wires.

17. The sheet stacker according to claim 1, wherein:

the interval between an outermost pair of the multiple lines increases toward the downstream in the conveyance direction.

18. The sheet stacker according to claim 1, wherein:

the interval between an innermost pair of the multiple lines increases toward downstream in the conveyance direction.

19. The sheet stacker according to claim 1, wherein:

the guide includes a guide member having a gap into which the leading end of the sheet is insertable, and the guide member holds the leading end of the sheet without a gripping force.

* * * * *